US010197958B2

(12) United States Patent
Takeda

(10) Patent No.: US 10,197,958 B2
(45) Date of Patent: Feb. 5, 2019

(54) IMAGE HEATING APPARATUS AND IMAGE FORMING APPARATUS

(71) Applicant: CANON KABUSHIKI KAISHA, Tokyo (JP)

(72) Inventor: Masami Takeda, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/454,285

(22) Filed: Mar. 9, 2017

(65) Prior Publication Data

US 2017/0269521 A1 Sep. 21, 2017

(30) Foreign Application Priority Data

Mar. 18, 2016 (JP) ..... 2016-055985

(51) Int. Cl.
*G03G 15/20* (2006.01)

(52) U.S. Cl.
CPC . *G03G 15/2053* (2013.01); *G03G 2215/2025* (2013.01)

(58) Field of Classification Search
CPC ..... G03G 15/2053; G03G 2215/2025
USPC ..... 399/330, 333
See application file for complete search history.

(56) References Cited

U.S. PATENT DOCUMENTS 8,918,040 B2 * 12/2014 Ishida ..... G03G 15/2053 399/329
9,128,434 B2 9/2015 Takahashi et al.

FOREIGN PATENT DOCUMENTS

| | | | |
|---|---|---|---|
| JP | 2012212066 | A | 11/2012 |
| JP | 2015059981 | A | 3/2015 |
| JP | 2015156047 | A | 8/2015 |
| JP | 2015194632 | A | 11/2015 |

* cited by examiner

*Primary Examiner* — Walter L Lindsay, Jr.
*Assistant Examiner* — Ruth Labombard
(74) *Attorney, Agent, or Firm* — Rossi, Kimms & McDowell LLP

(57) ABSTRACT

The fixing apparatus includes a cylindrical film, a nip member in contact with a film inner surface, wherein the nip member extends in a film longitudinal direction; a heater provided in a film hollow portion, a roller forming a nip portion where the recording material is conveyed and heated to fix the image on the recording material; a support member supporting the nip member, wherein a cross section of the support member perpendicular to the film longitudinal direction has a U-shape, and two end portions forming an opening portion in the U-shape support the nip member, an insulation member provided between the two end portions and the nip plate, and a reflection member surrounding the heater between the nip member and the support member, wherein the reflection member reflects the radiation heat of the heater toward the nip member.

10 Claims, 8 Drawing Sheets

IMAGE HEATING APPARATUS AND IMAGE FORMING APPARATUS

BACKGROUND OF THE INVENTION

Field of the Invention

The present invention relates to an image heating apparatus that heats a developer image on a recording material and an image forming apparatus including the image heating apparatus.

Description of the Related Art

A fixing apparatus using a cylindrical film is known as an image heating apparatus. A fixing apparatus that uses radiation heat of a halogen heater or the like to heat the inner surface of the film is practically used.

A fixing apparatus described in Japanese Patent Application. Laid-Open. No. 2012-212066 includes: a flexible cylindrical member; a heat generation member arranged inside of the cylindrical member; and a metal nip member (heated plate) arranged to come into sliding contact with the inner circumferential surface of the cylindrical member. The nip member is heated by the radiation heat from the heat generation member, and a reflection member that reflects the radiation heat of the heat generation member toward the nip member is further included. The cylindrical member is provided between the nip member heated by the heat generation member and a pressurization member, and a fixing nip is formed between the cylindrical member and the nip member.

In this way, the nip member is arranged at the fixing nip, and the nip member is intensively heated by the radiation heat of the heater. This can reduce the warmup time in the fixing apparatus.

However, in the fixing apparatus, a flange portion of the reflection member is provided between the nip member and a stay (pressurization stay), and the nip member is pressurized to a pressurization roller by the stay (pressurization stay). The material of the reflection member is an aluminum material with a good reflection efficiency, and the thermal conductivity is also good. On the other hand, the stay is required to have a high rigidity to allow forming a uniform fixing nip while withstanding a high pressure, and a thick metal is used. Therefore, the heat capacity is also larger than other metal components, and the heat of the nip member after the temperature is raised by the radiation heat is dissipated to the pressurization stay with a large heat capacity through the reflection member with a good thermal conductivity that is attached by high pressure. The heat leak slows down the rise in the temperature of the nip member and makes a reduction in the warm time of the fixing apparatus difficult.

SUMMARY OF THE INVENTION

A first aspect of the present invention provides a fixing apparatus that fixes an image on a recording material, including a cylindrical film, a nip member in contact with an inner surface of the film, wherein the nip member extends in a longitudinal direction of the film, a heater configured to heat the nip member by radiation heat, the heater provided in a hollow portion of the film; a roller configured to form a nip portion with the heater through the film, the nip portion being a portion where the recording material on which the image have been formed is conveyed and heated to fix the image on the recording material; a support member that supports the nip member, wherein a cross section of the support member perpendicular to the longitudinal direction of the film has a U-shape, and two end portions forming an opening portion in the U-shape support the nip member; an insulation member provided between the two end portions and the nip plate; and a reflection member provided so as to surround the heater in an area between the nip member and the support member, wherein the reflection member reflects the radiation heat of the heater toward the nip member.

A second aspect of the present invention provides a fixing apparatus that fixes an image on recording material, including a cylindrical film; a nip member in contact with an inner surface of the film, wherein the nip member extends in a longitudinal direction of the film, and the nip member includes a hollow portion extends in the longitudinal direction of the film as viewed in the longitudinal direction of the film, a heater configured to heats the nip member by radiation heat, the heater provided in the hollow portion, a roller configured to form a nip portion with the heater through the film, the nip portion being a portion where the recording material on which the image have been formed is conveyed and heated to fix the image on the recording material; and a support member that supports the nip member, wherein a cross section of the support member perpendicular to the longitudinal direction of the film has a U-shape, and two end portions forming an opening portion in the U-shape support the nip member.

Further features of the present invention will become apparent from the following description of exemplary embodiments with reference to the attached drawings.

DESCRIPTION OF THE EMBODIMENTS

Embodiments of an image heating apparatus and an image forming apparatus including the image heating apparatus according to the present invention will now be described in detail with reference to the attached drawings.

First Embodiment

The image forming apparatus to which the present invention is applied is an apparatus including an image forming unit that forms a toner image as a developer image on a recording material, and examples of the image forming apparatus include a printer, a copying machine and a facsimile using an electrophotographic system. In the present embodiment, toner is the developer the image forming unit, and an electrostatic image forming unit forms a toner image on tape recording material. A fixing apparatus that is an image heating apparatus fuses and fixes the toner image formed on the recording material.

Figure 4:
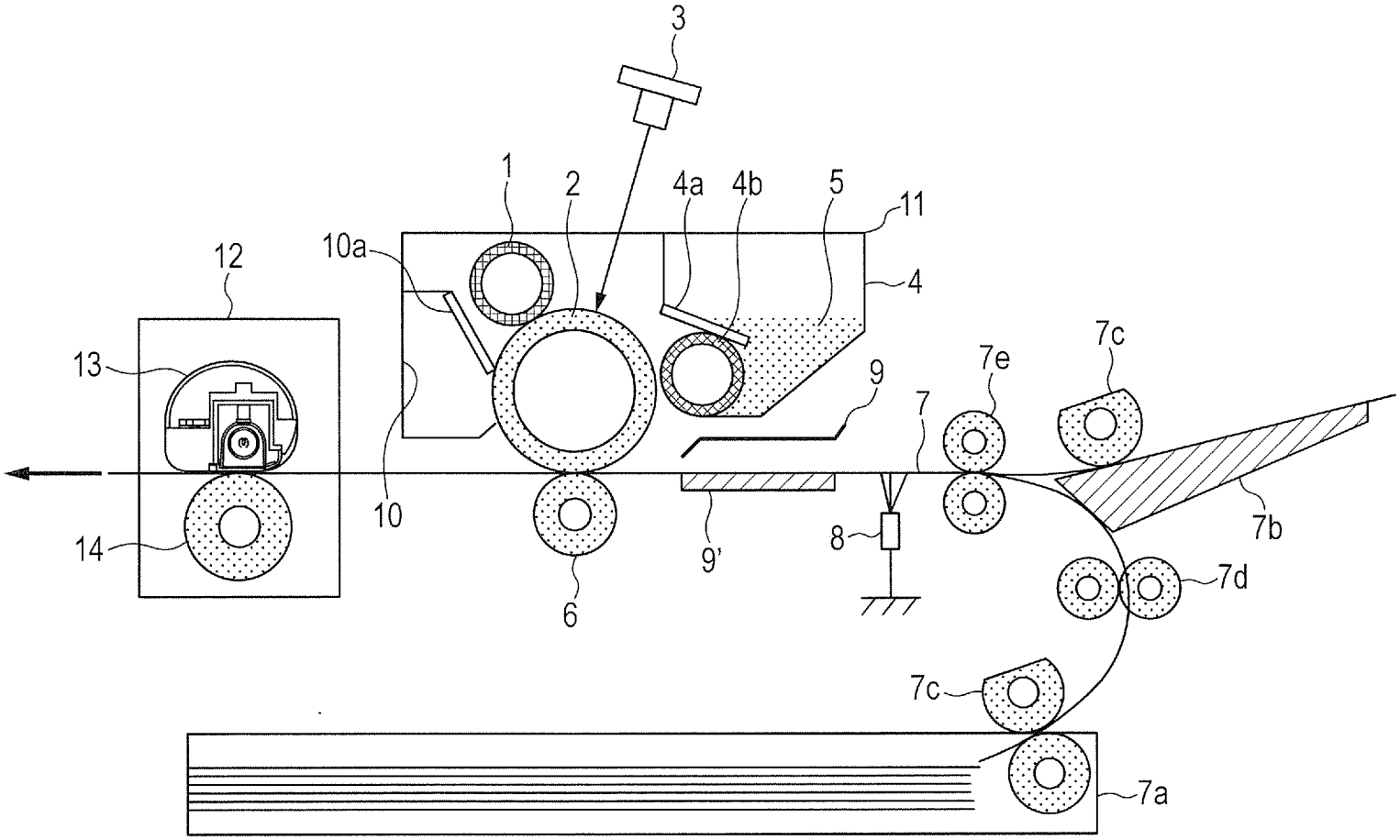
FIG. 4 is a diagram showing a configuration example of an image forming apparatus in which the fixing apparatus of the present invention is applied.

FIG. 4 illustrates a basic configuration of an electrophotographic monochrome printer as a basic example of the image forming apparatus.

More specifically, a charging roller 1 uniformly charges the surface of a photosensitive drum 2 to a predetermined polarity in the image forming unit. The charge is removed only from an area of the photosensitive drum 2 exposed by an exposure unit 3 such as a laser, and a latent image is formed on the photosensitive drum 2.

A developing device 4 visualizes the latent image as a toner image. More specifically, a toner 5 is frictionally charged to the same polarity as the surface of the photosensitive drum 2, between a developing blade 4*a* and a developing sleeve 4*b*. The frictionally charged toner 5 is conveyed to an opposing part of the photosensitive drum 2 and the developing sleeve 4*b* and is floated and vibrated by electrolytic action of superimposed application of DC and AC bias. The toner 5 is attached to the latent, image on the photosensitive drum 2 and developed.

The rotation of the photosensitive drum 2 conveys the toner image selectively attached and formed on the photosensitive drum 2 to a transfer nip formed by a transfer roller 6 and the photosensitive drum 2.

Other than the contactless system, an example of the development method up to this point includes a contact development system in which DC bias is applied while an elastic developing roller is in contact with the photosensitive drum, and the toner is selectively attached to a latent image forming unit of the photosensitive drum.

Meanwhile, a paper feeding roller pair 7*c* feeds a tip portion of a recording material 7, such as paper on which the image is to be recorded, to a vertical conveyance roller pair 7*d* from a recording material storage box 7*a*, and the vertical conveyance roller pair conveys the recording material 7 to pre-transfer conveyance rollers 7*e*. The pre-transfer conveyance rollers 7*e* further convey the recording material to the transfer nip at a predetermined entry angle along a transfer guide plate 9. During the conveyance, an anti-static brush 8 comes into contact with the back side of the recording material to remove unnecessary charge on the surface of the recording material, and the recording material is carried to the transfer nip.

At the transfer nip, a high voltage with a polarity opposite the toner is applied to the transfer roller 6 on the back of the recording material in order to electrostatically attract the toner on the photosensitive drum 2 to move the toner toward the recording material. At the same time, a transfer charge with a polarity opposite the toner is provided to the back surface of the recording material in order to maintain the toner on the recording material. Lastly, the recording material 7 provided with the toner image is conveyed to a fixing nip of a fixing apparatus 12 including a film unit 13 as a heating rotor and a pressurization roller 14.

At the fixing nip, to maintain a preset constant temperature, a constant temperature control unit (not illustrated) provided on the film unit 13 side as a heating rotor fixes the toner image by heating and pressurizing the toner image while controlling the temperature at the constant temperature.

A small amount of attached substances of the toner and the like with a different polarity remain on the surface of the photosensitive drum 2 after the transfer of the toner image. Therefore, a cleaning blade 10*a* removes the attached substances from the surface of the photosensitive drum 2 after the photosensitive drum 2 has passed through the transfer nip. The cleaning blade 10*a* comes into counter contact with the surface of the photosensitive drum 2 so as to counteract the rotation direction. The scraped attached substances of the toner and the like are recovered in a container 10 for the next image formation.

A monochromatic toner is used in the process described above. In a case of a color printer using a plurality of color toners, a plurality of color toner images is developed on one photosensitive drum, or a plurality of photosensitive drums corresponding to the number of colors of the color toners is used.

In the case of the color printer, there are various transfer systems for the process up to the formation of the toner image on the recording material. Examples of the transfer systems include a system of transferring multiple layers to an intermediate belt and then secondarily transferring the multiple layers to the recording material all at once and a system of transferring multiple layers to the recording material while adsorbing and conveying the recording material on the transfer belt.

It is common to any of the transfer systems that in order to permanently fix the transferred toner image on the recording material, the printing is ultimately finished through the fixing apparatus 12 that pressurizes and heats the toner to permanently fix the toner on the recording material.

<Fixing Apparatus>

The fixing apparatus will be described in detail with reference to FIGS. 1A to 2B.

Figure 1A:
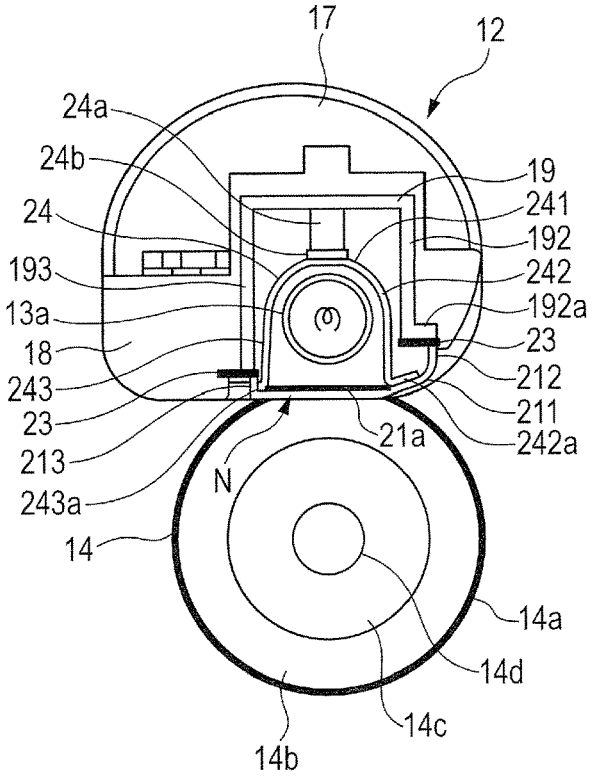
FIG. 1A is a side view of a fixing apparatus (image heating apparatus) according to a first embodiment of the present invention.
Figure 1B:
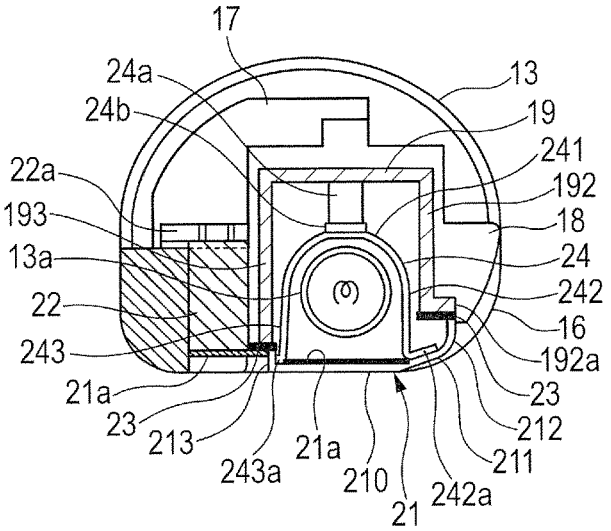
FIG. 1B is a cross-sectional view of an upper unit of the fixing apparatus.
Figure 2A:
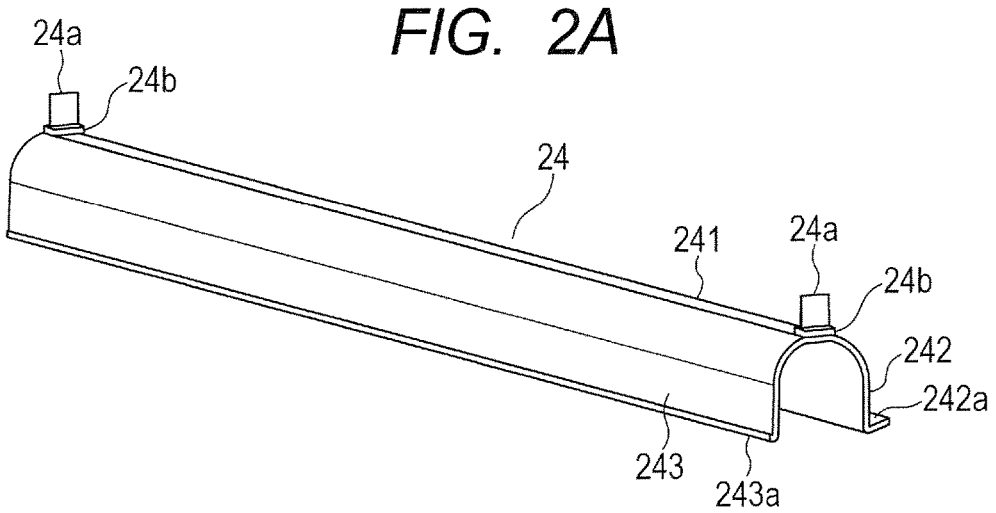
FIG. 2A is an exploded perspective view of a reflection plate.
Figure 2B:
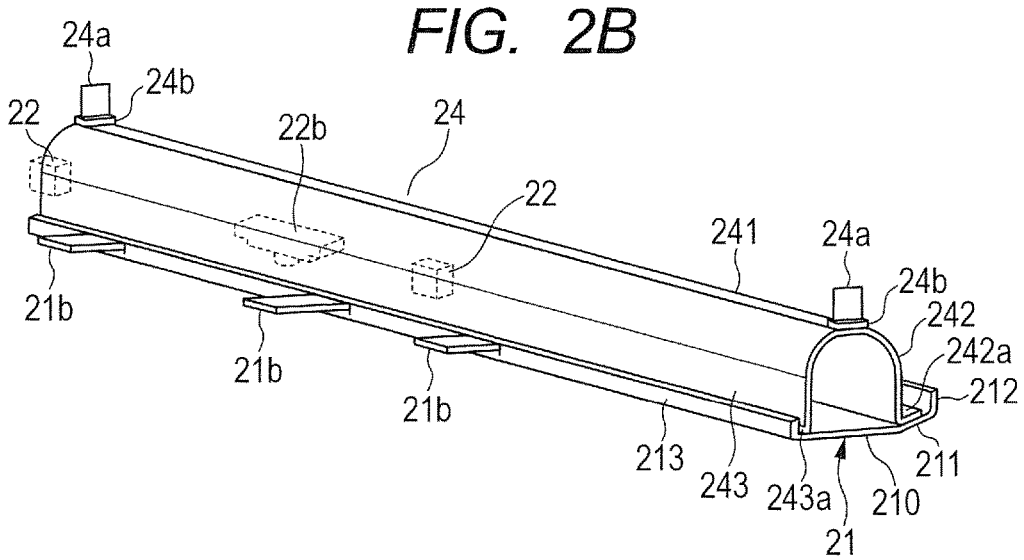
FIG. 2B is a perspective view of a combined state.

FIG. 1A is a side view of the fixing apparatus. FIG. 1B is a cross-sectional view of the film unit. FIG. 2A is a perspective view of a reflection plate. FIG. 2B is a perspective view of a combination of the reflection plate and a heated plate.

The fixing apparatus 12 of the present invention is a film-heating fixing apparatus in which a reflection plate 24 uses radiant light from a heat generation member 13*a* to intensively heat a heated plate 21 facing a fixing nip portion N to heat a fixing film 16 brought into contact and slid against the heated plate 21. An example of the heat generation member 13*a* includes a halogen heater.

Therefore, the fixing apparatus 12 includes: the film unit 13 as a heating rotor; and the pressurization roller 14 as a pressurization member that comes into contact with the film unit 13 to form the fixing nip portion N.

The film unit 13 includes: the fixing film 16 as a flexible and rotatable cylindrical member; and the heat generation member 13*a* extending in a rod shape, the heat generation member 13*a* serving as a radiant heat generation member arranged inside of the fixing film 16. The film unit 13 further includes: the heated plate (nip member) 21 arranged to be able to slide against the inner circumferential surface of the fixing film 16 and heated by the radiation heat, from the heat generation member 13*a*; and the reflection plate (reflection member) 24 as a reflection unit that reflects the radiation heat of the heat generation member 13*a* toward the heated plate 21. The fixing film 16 is provided between the pressurization roller 14 and the heated plate 21 to form the fixing nip portion N between the pressurization roller 14 and the fixing film 16. The recording material provided with the image is conveyed and heated at the fixing nip portion N, and the image is fixed to the recording material.

Although not particularly illustrated, the fixing film 16 has a laminated film configuration, such as a two-layer structure with a base layer and a release layer and a three-layer structure provided with an elastic layer between the base layer and the release layer. The base layer includes a polyimide heat-resistant resin film made of a polyimide or the like or a film-like thin metal layer with a high thermal conductivity. The release layer is a surface part of the film and is formed by PFA or PTFE with a good release property. An example of the elastic layer includes silicone rubber.

A film guide 18 that guides the fixing film 16 is provided inside of the fixing film 16, and a metal pressurization stay (support member) 19 for uniformly pressurizing the fixing nip portion N between the heated plate 21 and the pressurization roller is arranged inside of the film guide 18. An upper cover stay 17 for preventing contact of a wiring member of an internal electrical component and the fixing film 16 is also provided.

The pressurization stay 19 extends in the flexible and rotatable cylindrical member with an inverted U-shape in cross section that opens toward the heated plate 21, and the heat generation member 13*a* and the reflection plate 24 are provided in the internal space. The heated plate 21 is assembled so as to block a lower end open part of the pressurization stay 19. The cross section of the pressurization stay 19 perpendicular to the longitudinal direction of the fixing film 16 is U-shaped, and two end portions forming the U-shaped opening portion support the heated plate 21.

The reflection plate 24 is arranged to focus the radiant light of the heat generation member 13*a* on the fixing nip portion N.

The heated plate 21 is a plate-like member extending in a direction orthogonal to the paper feed direction, extending parallel to the heat generation member 13*a*. The heated plate 21 has a function of receiving the radiant light reflected by the reflection plate 24 to raise the temperature for heating and a function of a fixation pressurization member that forms the fixing nip portion N while sliding against the fixing film 16 rotated and moved between the heated plate 21 and the pressurization roller 14. A black paint, layer 21*a* for increasing the absorption of the radiant light is formed on the heater side surface of the heated plate 21.

In the illustrated example, a recording material P is conveyed from the right side in the drawings. The recording material P passes through the fixing nip portion N and is ejected to the left side in the drawings. The film unit 13 has a shape projecting significantly more than the nip width toward the downstream in the conveyance direction of the recording material P. As a result, the area that the fixing film 16 is horizontally conveyed near the fixing nip portion N is longer than in conventional examples.

A contact seat 21*b* partially extending toward the downstream in the paper feed direction is provided on the downstream end portion of the heated plate 21 in the paper feed direction (conveyance direction of the recording material), and a thermistor 22*b* is arranged in contact with the contact seat 21*b*. The thermistor 22*b* is inserted into a hole provided on the film guide 18, and the upper cover stay 17 screwed to a pressure spring 22*a* and the film guide 18 on the upper side pressure welds the thermistor 22*b* to the contact seat 21*b*.

More specifically, a temperature detector based on the thermistor 22*b* is provided on the downstream part of the fixing nip portion N of the heated plate 21 in the paper feed direction, and the thermal conductivity of the metal heated plate 21 is utilized to detect a temperature close to the temperature of the fixing nip portion N. To reserve the space of the temperature detector, the downstream of the film unit 13 is extended longer than the upstream in the paper feed direction relative to the fixing nip portion N.

Thermo-switches 22 are provided on both sides in the longitudinal direction of the thermistor 22*b* arranged on the fixation center part. To reserve the contact locations of the thermo-switches 22, contact seats 21*b* as seats of the thermo-switches 22 partially protrude at edges on the downstream of the heated plate 21 in the paper feed direction (conveyance direction of the recording material), just like the contact seat 21*b* contacted by the thermistor 22*b*. Temperature sensors of the thermistor 22*b* and the thermo-switches 22 are held in holding holes opened in the film guide 18.

Meanwhile, the pressurization roller 14 as a pressurization member includes: an elastic layer 14*b* made of heat-resistant rubber or the like on a pressurization metal cored bar 14*c* including a rotation axis 14*d*; and a pressurization side release layer 14*a* on the surface of the elastic layer 14*b*.

In the present, first embodiment, a front flange portion 242*a* of the reflection plate 24 is connected with a good thermal conductivity to the back side of the fixing nip of the heated plate 21, and the reflection plate 24 and the pressurization stay 19 are contactless and insulated. As for fixing the reflection plate 24, pressure springs 24*a* are provided between the upper surface of both end portions of the reflection plate 24 in the longitudinal direction and a ceiling portion 191 of the pressurization stay 19 through an insulation base 24*b* to pressurize and fix the reflection plate 24.

The reflection plate 24 extends in the flexible and rotatable cylindrical member with an inverted U-shape in cross section that opens toward the heated plate 21 so as to surround three sides of the heat generation member 13*a* and includes a top surface portion 214 on the opposite side of the heated plate 21. A front side portion 242 is arranged on the upstream of the heat generation member 13*a* in the conveyance direction, and a back side portion 243 is arranged on the downstream in the conveyance direction. A front flange portion 242*a* projecting toward the upstream in the conveyance direction is provided on the lower end part that is an open end of the front side portion 242, and a back flange portion 243*a* projecting toward the downstream in the conveyance direction from the lower end part that is an open end of the back side portion 243 is provided.

In the first embodiment, the front flange portion 242*a* at the lower end of the front side portion 242 is in contact with the back surface of the fixing nip portion N of the heated plate 21.

The heated plate 21 includes: a plate-like flat portion 210 of an area corresponding to the fixing nip portion N; an inclined surface portion 211 further extending and inclined at a predetermined angle toward the upstream from the upstream end of the flat portion 210 in the conveyance direction; a front end wall 212 extending upward at a right angle to the flat portion 210 from the upstream end of the inclined surface portion 211 in the conveyance direction; and a back end wall 213 extending upward at a right angle from the downstream end of the flat portion 210 in the conveyance direction. The contact seats 21*b* further partially extend parallel to the conveyance direction from the upper end of the back end wall 213.

In the first embodiment, the front flange portion 242*a* of the reflection plate 24 is in surface contact with the inclined surface portion 211 of the heated plate 21 and is connected such that the thermal conductivity is thermally favorable. The back flange portion 243*a* is also in contact with a corner portion of the flat portion 210 and the back end wall 213 of the heated plate 21 and is connected such that the thermal conductivity is thermally favorable.

In the present first embodiment, between both end portions of the reflection plate 24 in the longitudinal direction and the pressurization stay 19, the pressure springs 24*a* as pressurization members are pressurized and attached between the end portions and the ceiling portion on the inner surface of the pressurization stay 19 through the insulation base 24*b* as an insulation member. The pressurization stay 19 extends in the flexible and rotatable cylindrical member with a U-shape in cross section surrounding the reflection plate 24 and includes: the ceiling portion 191; a front wall portion 192 on the upstream in the conveyance direction; and a back wall portion 193 on the downstream in the conveyance direction. A fixation flange 192*a* provided on the lower end part that is an open end of the front wall portion 192 is pressurized and fixed to the upper end of the front end wall 212 of the heated plate 21 through a heat-resistant insulation material 23 as an insulation material (insulation member). The lower end part of the back wall portion 193 is pressurized and fixed to the upper end of the back end wall 213 of the heated plate 21 through the heat-resistant insulation material 23. Therefore, the two end portions (the tip of the front wall portion 192 and the tip of the back wall portion 193) forming the U-shaped opening portion of the pressurization stay 19 support the heated plate through the insulation member.

In this way, the front flange portion 242*a* of the reflection plate 24 provided between the conventional pressurization stay 19 and the heated plate 21 is brought into contact with the back side of the fixing nip of the heated plate 21 from the interface and is connected to the heated plate 21 with a good thermal conductivity in the present first embodiment.

According to the configuration, leak of thermal energy at the rise of temperature of the reflection plate 24 to the pressurization stay 19 is prevented. The reflection plate 24 is in thermally close contact with the heated plate 21, and the thermal energy can be transferred with a favorable thermal conductivity. Therefore, the temperature of the heated plate 21 rises faster.

More specifically, while the reflection plate 24 reflects the radiant light from the heat generation member 13*a* toward the fixing nip portion N, the reflection plate 24 also holds thermal energy after the temperature is raised by the radiant light. Only the insulation base 24*b* supports the portion between the reflection plate 24 and the pressurization stay 19, and the reflection plate 24 and the pressurization stay 19 are insulated by the heat-insulating insulation material 23. Therefore, the thermal energy of the reflection plate 24 can be actively transferred toward the heated plate 21 without the dissipation of the thermal energy to the pressurization stay 19. The temperature rise speed of the heated plate 21 can be increased, and the rise performance of the entire fixing apparatus can be improved.

(Comparative Test of Rise Characteristics)

Figure 3:
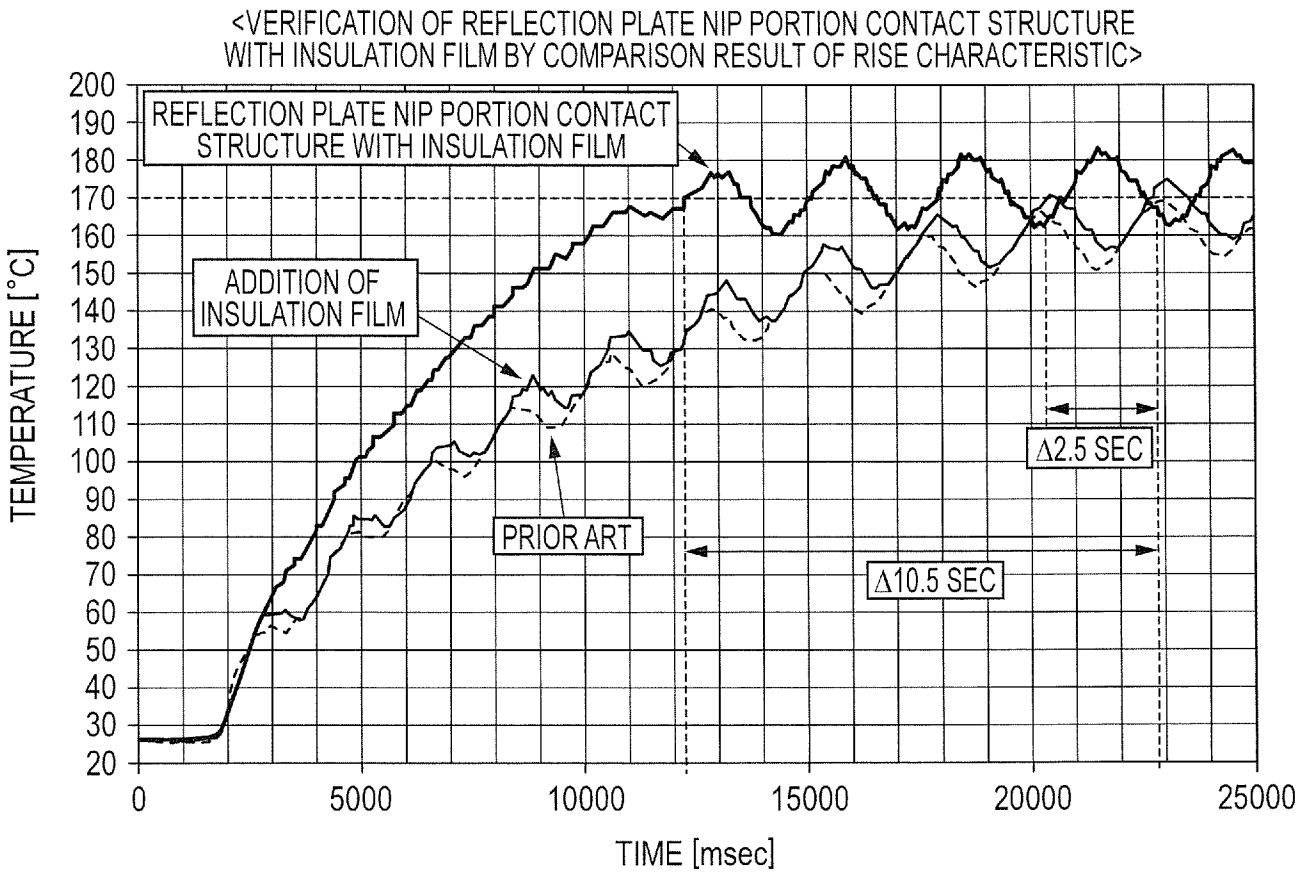
FIG. 3 is a graph of rise characteristics of the present invention and comparative examples.

FIG. 3 illustrates comparison results of rise characteristics of the present invention and comparative examples of the present invention.

Figure 8:
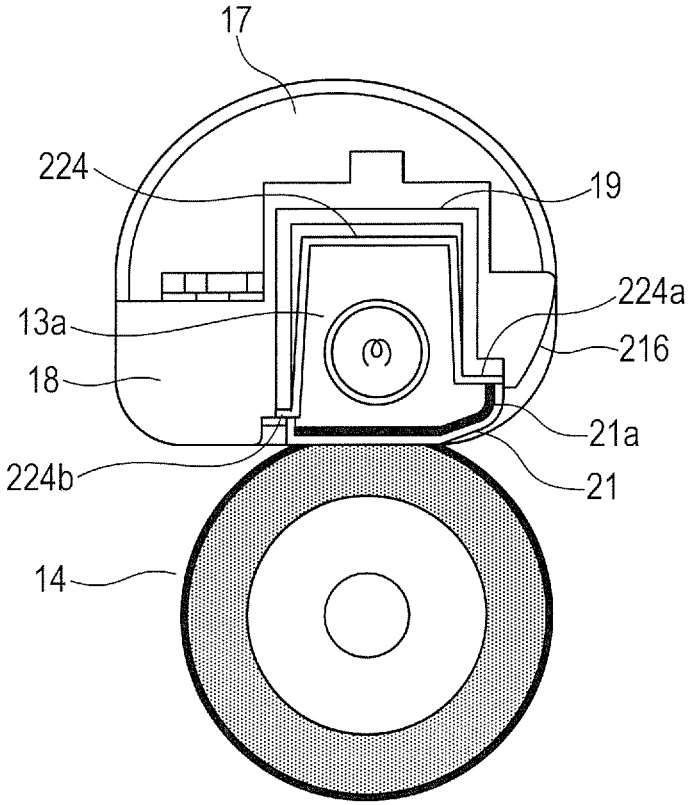
FIG. 8 is a side view of a fixing apparatus of a first comparative example.

A first comparative example is a conventional configuration type in which flange portions 224*a* and 224*b* of a reflection plate 224 are provided and fixed between the lower end of the pressurization stay 19 and the heated plate 21 as illustrated in FIG. 8. The same reference signs are provided to the same constituent elements as in the present first embodiment. The materials and the thicknesses of the members are the same for the same constituent elements, and the difference in performance caused by the difference in material characteristics can be substantially ignored even if there is a little change in the heat capacity associated with a change in the shape.

In a second comparative example, the flange portions 224*a* and 224*b* of the reflection plate 224 are provided and fixed between the lower end of the pressurization stay 19 and the heated plate 21 through an insulation material as compared to the first comparative example. An example of the insulation material includes a polyimide film with a thickness of about 0.1 mm, and the bottom surface of the pressurization stay 19 is covered by the film.

Compared to the comparative examples, the insulation material 23 used in the present first embodiment is also a polyimide film with a thickness of about 0.1 mm as in the comparative example 2, and the bottom surface of the pressurization stay 19 is also covered by the film.

The comparative test is conducted for the fixing apparatus in three kinds of configuration, and single devices in the present fixing system with a performance equivalent to the print speed of 40 sheets (LTR sized paper) per minute are evaluated. The verification experiment is conducted from the room temperature to the fixation control temperature that is set at 170° C.

FIG. 3 is a graph of results of the verification of the difference in the rise characteristics. The first comparative example is indicated by a waveform of a dashed line. The second comparative example is indicated by a waveform of a thin solid line. The present first embodiment is indicated by a waveform of a thick solid line.

As can be understood from the graph, although the speed, the temperature control method, the target temperature and the like are all set to the same conditions as in the conventional examples, the rise time when the target fixation temperature control temperature is 170° C. is as follows.

Although the second comparative example has an advantageous effect of an improvement of about 2.5 seconds compared to the first comparative example, there is a large difference of about 10.5 seconds when the configuration of the present first embodiment is used.

As a result, it can be understood that the configuration of the present first embodiment has an advantageous effect of reducing the rise time by about 8 seconds even if the advantageous effect of the insulation material is excluded.

More specifically, the first and second comparative examples have a little difference due to whether the heat-resistant film as a simple insulation material is used. However, the rise in the temperature of the heated plate 21 heated by the radiant light of the heat generation member 13*a* is prevented by the leak of the thermal energy of the heated plate 21 to the pressurization stay 19 through the reflection plate 224 with a good thermal conductivity. The own thermal energy of the reflection plate 24 is also leaked to the pressurization stay 19, and the temperature rise speed of the heated plate 21 is further prevented.

However, the arrangement configuration of the reflection plate 24 of the present first embodiment and the configuration of using both the configuration and the simple insulation material can prevent the movement of the heat to the pressurization stay 19 and significantly improve the rise performance.

An insulation material needs to be newly added to provide the insulation member in the configuration described above. However, instead of newly adding a heat-resistant resin member such as the polyimide film, the film guide 18 similarly made of a heat-resistant resin may be deformed and provided to stick out from the boundary. Although the insulation material 23 is a simple insulation material in the present embodiment to check the advantageous effect of the arrangement of the reflection plate, an insulation material with a lower thermal conductivity may be selected to further prevent the leak of the thermal energy of the heated plate 21 to the pressurization stay 19.

Next, second to fourth embodiments of the present invention will be described.

Differences from the first embodiment will be mainly described in the following description. The same reference signs are provided to the same constituent components, and the description will not be repeated.

Second Embodiment

Figure 5A:
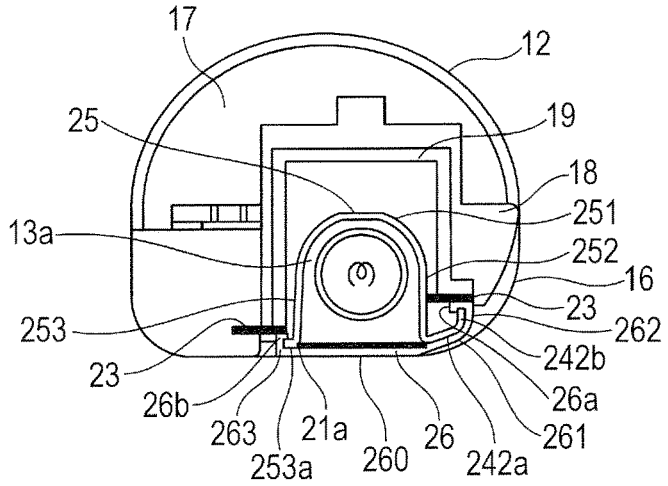
FIG. 5A is a cross-sectional view of a film unit of a second embodiment of the present invention.
Figure 5B:
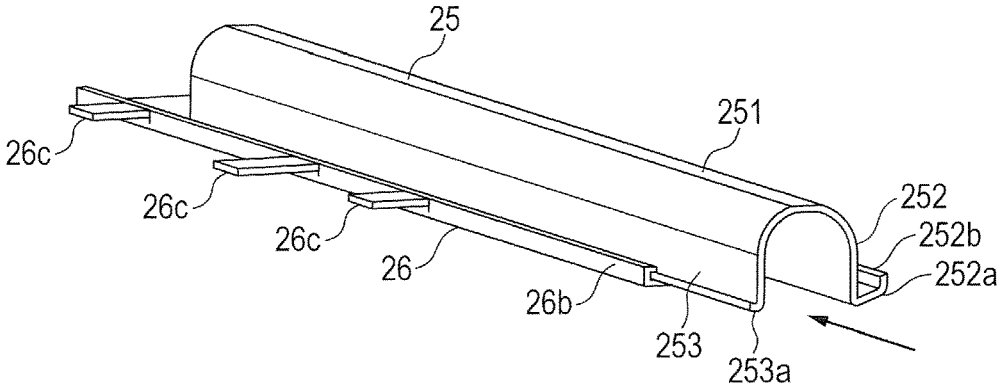
FIG. 5B is an exploded perspective view of a reflection plate.
Figure 5C:
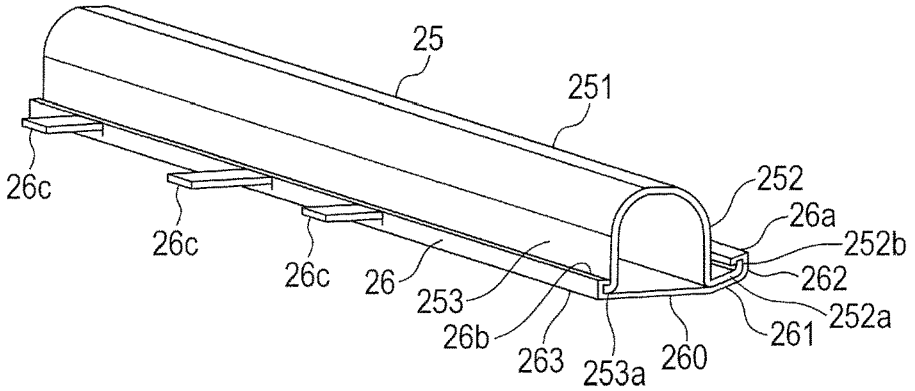
FIG. 5C is a perspective view of an assembled state of the reflection plate and a heated plate.

FIGS. 5A to 5C illustrate a film unit of a fixing apparatus according to a second embodiment of the present invention. FIG. 5A is a side view of the film unit, and FIGS. 5B and 5C are perspective views of a reflection plate 25 and a heated plate 26 with claws. Although the reflection plate 25 in the same shape as the member in the first embodiment can be used, the shape is changed here according to the shape of the heated plate 26, and the reflection plate 25 is a different component.

As illustrated in FIG. 5A, the heated plate 26 with claws used in the present second embodiment include an upstream claw portion 26*a* and a downstream claw portion 26*b* formed by bending sheet metal end portions at both end portions on the upstream and the downstream of the fixing nip of the heated plate 26 used in the first embodiment. Although the upstream claw portion 26*a* and the downstream claw portion 26*b* may be only partially provided as long as the claw portions are functionally effective, the claw portions are formed throughout the entire area the longitudinal direction here in order to particularly ensure the adhesion between the sheet metals throughout the entire area. The shape of the upper surface of the heated plate 26 is processed according to the shape of the bottom surface of the reflection plate 25.

More specifically, the reflection plate 25 extends in the heated plate 26 with an inverted U-shape in cross section that opens toward the heated plate 26 so as to surround three sides of the heat generation member 13*a* and includes a top surface portion 251 on the opposite side of the heated plate 26. A front side portion 252 is arranged on the upstream of the heat generation member 13*a* in the conveyance direction, and a back side portion 253 is arranged on the downstream in the conveyance direction. A front flange portion 252*a* projecting toward the upstream in the conveyance direction is provided on the lower end part that is an open end of the front side portion 252, and a back flange portion 253*a* projecting toward the downstream in the conveyance direction from the lower end part that is an open end of the back side portion 253 is provided.

An engagement end portion engaged with the upstream claw portion 26*a* is bent and extended at the tip of the front flange portion 252*a*.

Meanwhile, the heated plate 26 includes: a plate-like nip corresponding portion 260 of an area corresponding to the fixing nip portion N; an inclined surface portion 261 further extending and inclined at a predetermined angle toward the upstream from the upstream end of the nip corresponding portion 260 in the conveyance direction; a front end wall 262 extending upward at a right angle to the nip corresponding portion 260 from the upstream end of the inclined surface portion 261 in the conveyance direction; and a back end wall 263 extending upward at a right angle from the downstream end of the nip corresponding portion 260 in the conveyance direction. The downstream claw portion 26*b* is folded back toward the upstream in the conveyance direction from the upper end of the back end wall 263. Contact seats 26*c* contacted by the thermistor 22 and the like partially protrude toward the downstream in the conveyance direction from the upper end of the back end wall 263. The downstream claw portion 26*b* is not formed at the parts provided with the contact seats 26*c*.

In the second embodiment, a tip engagement portion 252*b* of the front flange portion 252*a* of the reflection plate 25 is brought in line with the upstream claw portion 26*a* of the heated plate 26 as illustrated in FIG. 5B, and the back flange portion 253*a* is brought in line with the downstream claw portion 26*b*. The portions are slid and inserted in an arrow X direction and are advanced until the end portions of both components in the longitudinal direction coincide as illustrated in FIG. 5C. In this way, the reflection plate 25 and the heated plate 26 are attached and fixed.

In this way, in the present second embodiment, the reflection plate 25 is attached and held only by the heated plate 26 independently from other members, without using other pressurization units. Therefore, there is no route for heat leak from the reflection plate 25 to the members other than the heated plate 26, and a configuration with a higher thermal efficiency can be realized. Furthermore, the configuration with a high thermal efficiency can be realized by an inexpensive configuration without adding other pressure springs or insulation bases as in the first embodiment.

In this way, the claw portions for fixing the reflection plate 25 are provided on the upstream and the downstream of the heated plate 26 in the conveyance direction in the present second embodiment, and the dissipation of the thermal energy of the reflection plate 25 toward the pressurization stay 19 can be prevented. At the same time, the front flange portion 252*a* and the back flange portion 253*a* of the reflection plate 25 can be closely connected to the back side of the fixing nip of the heated plate 26. Therefore, a favorable advantageous effect can be obtained without adding other components. Furthermore, the insulation material 23 is provided between the connection portion of the reflection plate 25 and the heated plate 26 and the pressurization stay 19, and a further favorable advantageous effect can be obtained.

Third Embodiment

Figure 6A:
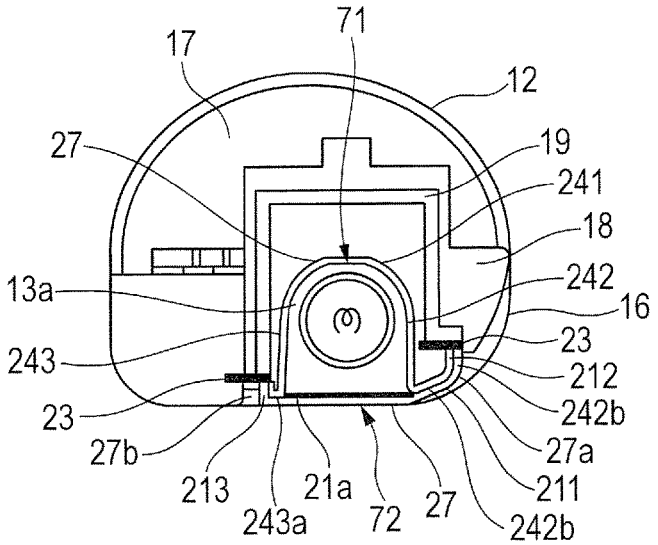
FIG. 6A is a cross-sectional view of a film unit of a third embodiment of the present invention.
Figure 6B:
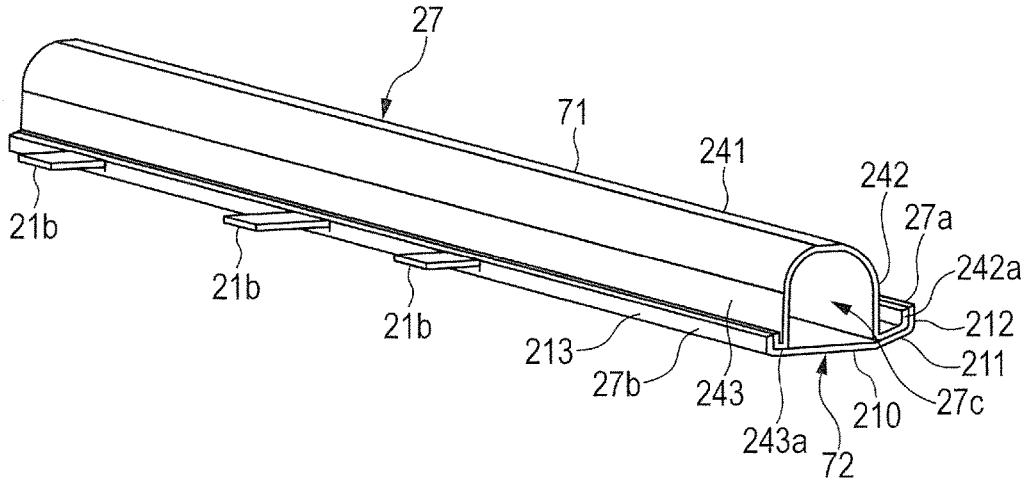
FIG. 6B is a perspective view of a reflection plate and a heated plate.

FIGS. 6A and 6B illustrate a film unit of a fixing apparatus according to a third embodiment of the present invention. FIG. 6A is a side view of the film unit, and FIG. 6B is a perspective view of a hollow member 27.

In the present third embodiment, a reflection plate portion (reflection plate) 71 and a heated plate portion (heated plate) 72 are formed by the hollow member 27 integrally molded by bending one metal plate as illustrated in FIGS. 6A and 6B. This allows favorably move the thermal energy generated in the reflection plate portion 71 to the heated plate portion 72 to improve the heating efficiency of the fixing nip portion N, and at the same time, a reduction in the number of components and an improvement in the ease of assembly can be realized.

More specifically, the reflection plate portion 71 extends in the flexible and rotatable cylindrical member with an inverted U-shape in cross section surrounding three sides of the heat generation member 13*a*. The reflection plate portion 71 is provided with: a top surface portion 241 on the opposite side of the heated plate portion 72; the front side portion 242 on the upstream of the heat generation member 13*a* in the conveyance direction; and the back side portion 243 on the downstream in the conveyance direction. The front flange portion 242*a* projecting toward the upstream in the conveyance direction is provided on the lower end part that is an open end of the front side portion 242, and the back flange portion 243*a* projecting toward the downstream in the conveyance direction from the lower end part that is an open end of the back side portion 243 is provided.

A connection portion 242*b* connected to the heated plate portion 72 is bent and extended at the tip of the front flange portion 242*a*.

Meanwhile, the heated plate portion 72 includes: the plate-like flat portion 210 of the area corresponding to the fixing nip portion N; the inclined surface portion 211 further extending and inclined at a predetermined angle toward the upstream from the upstream end of the flat portion 210 in the conveyance direction; the front end wall 212 extending upward at a right angle to the flat portion 210 from the upstream end of the inclined surface portion 211 in the conveyance direction; and the back end wall 213 extending upward at a right angle from the downstream end of the flat portion 210 in the conveyance direction.

The front flange portion 242*a* of the reflection plate portion 71 is formed on the inclined surface portion 211 of the heated plate portion 72, and an upstream overlapped portion 27*a* on which the connection portion 242*b* is put together is formed on the front end wall 212. A downstream overlapped portion 27*b* is also formed, in which the back end wall 213 of the heated plate portion 72 and a front end folded portion 243*b* of the back flange portion 243*a* are put together.

More specifically, the hollow member 27 has a hollow structure with a closed cross section, in which the upstream overlapped portion 27*a* does not include seams, and the downstream overlapped portion 27*b* includes seams. The hollow member 27 includes a hollow portion 27*c* formed by the flat portion 210 of the heated plate portion 72 and the reflection plate portion 71, and the upstream overlapped portion 27*a* and the downstream overlapped portion 27*b* project at the upstream end portion and the downstream end portion of the hollow portion 27*c*. The heat generation member 13*a* is arranged on the hollow portion 27*c*.

To mold the hollow member 27, an aluminum plate with a thickness of 0.5 mm is used as a metal member with a high thermal conductivity, and the tip overlapped portion 27*a* is first formed as an upstream contact portion illustrated in FIG. 5A. More specifically, the plate is folded once, and the entire overlapped part is further bent to form a curved area. The lower sheet metal portion is extended to form the flat portion 210 facing the fixing nip. Meanwhile, the upper sheet metal portion is bent upward to form the dome-shaped reflection plate portion 71, and the both portions are folded again to form the back end overlapped portion 27*b*. As illustrated in FIG. 5B, the contact seats 21*b* for attaching the temperature sensors are formed by partially extending and bending the lower sheet metal. Therefore, the contact seats 21*b* are left off in advance on the sheet metal end portion when the base metal plate is planar.

The configuration of further bending the overlapped portions at the front end overlapped portion 27*a* and the back end overlapped portion 27*b* is effective in increasing the heat transfer area and increasing the rigidity. More specifically, in the heat transfer of the thermal energy generated in the reflection plate portion 71 to the nip area of the heated plate portion 72, the overlapped portions in addition to the regular thermal conduction route of the base metal plate can further increase the heat transfer area. This can obtain an advantageous effect of promoting the heat transfer and an advantageous effect of supplementing the lack of rigidity for withstanding the pressure of the fixing nip portion when a thin metal plate is used, and this is also effective in ensuring the rigidity. In this way, the fact that the thin metal can be used corresponds to the objects of "reducing the heat capacity" and "speeding up the heat transfer in the thickness direction" in order to increase the speed of the heat transfer.

When the configuration is used, the black paint layer 21*a* important in increasing the heating efficiency of the fixing nip portion is painted by one of the following methods.

Partially paint in advance the position equivalent to the nip of the sheet metal before processing.

Use a painting nozzle that can be inserted into the dome-shaped hollow portion after processing to paint only the lower surface by masking.

An example of the masking method includes a method of attaching a surface protection member on the unpainted surface, and an example of a more productive method includes the following method. A method of using a cover with a high dimensional accuracy for an internal dome shape that can highly accurately cover the surface other than the lower surface to be painted can be used. A method of using a flanged nozzle with a high dimensional accuracy for an internal dome shape that can highly accurately prevent scattering of the paint to the upper part of the painting nozzle can also be used.

Although the metal plate is used as a metal base material in the configuration, a metal pipe may be used as a metal base material. A similar shape may be formed by a pressurization deformation process, and an unnecessary part of the back end portion may be deleted to cut out the contact seats 21*b* of the temperature sensors.

Although the front end overlapped portion 27*a* and the back end overlapped portion 27*b* are simply connected by pressure bonding when the configuration is used, the following connection methods may be used to stabilize the adhesion of the overlapped interfaces. For example, other connection methods, such as welding, friction stir welding and ultrasonic metal welding, can be used for the connection in each area of the overlapped interface. However, a processing method that does not generate unevenness or burr on the surface of the heated plate portion 72 rubbed against the fixing film 16 is desirable.

In this way, the reflection plate portion 71 is integrated with the heated plate portion 72 in the present third embodiment, and there is no route of heat leak from the reflection plate portion 71 to the members other than the heated plate portion 72, except for a little heat leak to the insulation member of the pressurization seat. The heat is transferred with a higher thermal conductivity due to the integration, and a configuration with a higher thermal efficiency can be realized.

Therefore, the reflection plate portion 71 and the heated plate portion. 72 are integrally formed by bending the metal plate of the same metal member and deforming the pipe, and the thermal energy generated in the reflection plate portion 71 can be transmitted to the heated plate portion 72 with a good thermal conductivity.

Fourth Embodiment

Figure 7A:
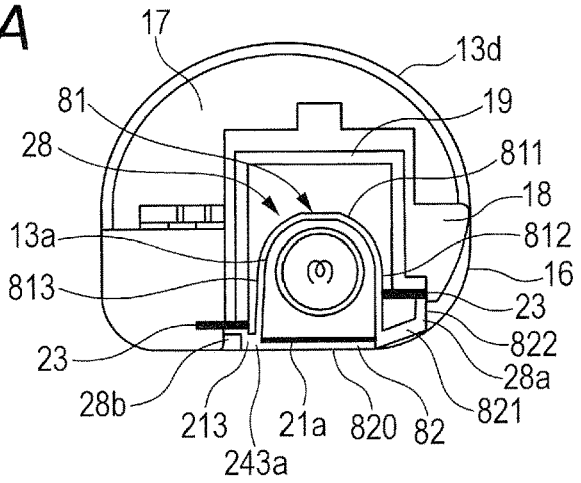
FIG. 7A is a cross-sectional view of a film unit of a fourth embodiment of the present invention.
Figure 7B:
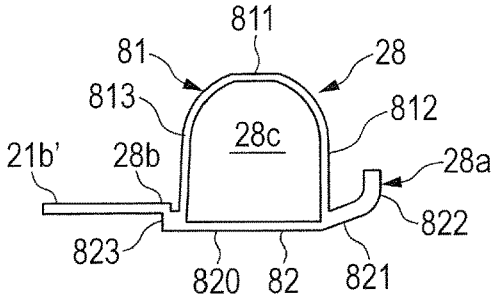
FIG. 7B is a cross-sectional view of a reflection plate and a heated plate in an integrated structure.
Figure 7C:
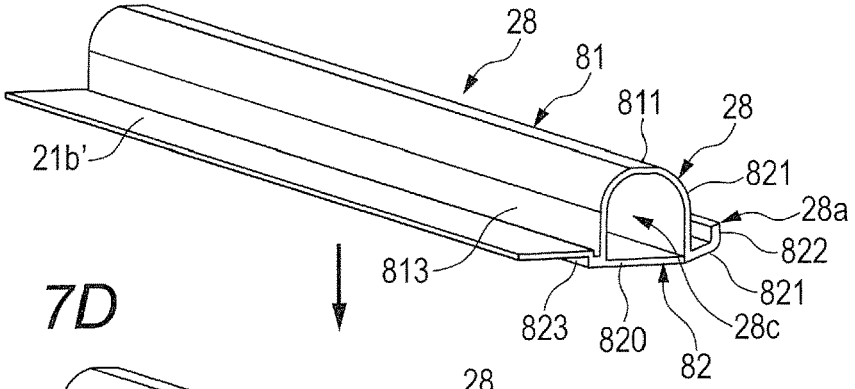
FIG. 7C is a perspective view of an intermediate molded body.
Figure 7D:
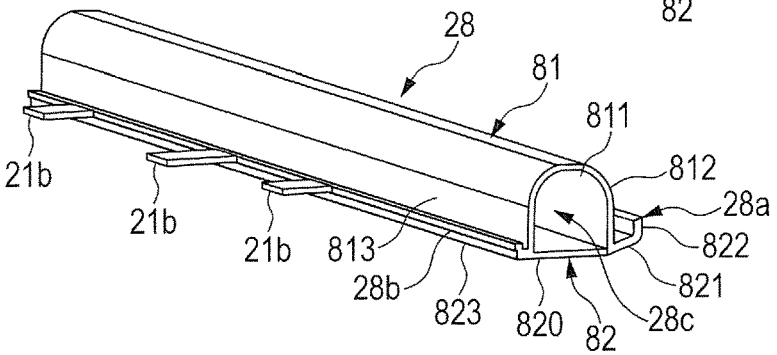
FIG. 7D is a view after molding of seats.

FIGS. 7A to 7D illustrate a film unit of a fixing apparatus according to a fourth embodiment of the present invention. FIG. 7A is a side view of the film unit. FIG. 7B is a cross-sectional view of a hollow member 28. FIGS. 7C and 7D are perspective views before and after sensor seat formation of a hollow member.

In the present fourth embodiment, a reflection plate portion 81 and a heated plate portion 28B are formed by the hollow member 28 without seams.

In the fourth embodiment, the reflection plate portion 81 and a heated plate portion 82 are integrally formed by the same metal material with a high thermal conductivity to favorably move the thermal energy generated in the reflection plate portion 81 to the heated plate portion 82 as in the third embodiment. This can improve the heating efficiency of the fixing nip portion and can realize a reduction in the number of components and an improvement in the ease of assembly.

More specifically, the reflection plate portion 81 extends in the flexible and rotatable cylindrical member with an inverted U-shape in cross section surrounding three sides of the heat generation member 13*a* and is provided with: a top surface portion 811 on the opposite side of the heated plate portion 82; a front side portion. 812 on the upstream of the heat generation member 13*a* in the conveyance direction; and a back side portion 813 on the downstream in the conveyance direction.

Meanwhile, the heated plate portion 82 includes: a plate-like flat portion 820 of an area corresponding to the fixing nip portion; an inclined surface portion 821 further extending and inclined at a predetermined angle toward the upstream from the upstream, end of the flat portion 820 in the conveyance direction; a front end wall 822 extending upward at a right angle to the flat portion 820 from the upstream end of the inclined surface portion 821 in the conveyance direction; and a back end wall 823 extending upward at a right angle from the downstream end of the flat portion 820 in the conveyance direction.

The lower end of the front side portion 812 of the reflection plate portion 81 is integrally connected to the boundary of the flat portion 820 and the inclined surface portion 821 of the heated plate portion 82, and the lower end of the back side portion 813 is integrally connected to the boundary of the flat portion 820 and the back end wall 823 of the heated plate portion 82.

More specifically, the hollow member 28 includes a hollow portion 28*c* with a closed cross section including the flat portion 820 of the heated plate portion 82 and the reflection plate portion 81, and an upstream blade portion 28*a* and a downstream blade portion 28*b* project at the upstream end portion and the downstream end portion of the hollow portion 28*c*. The upstream blade portion 28*a* forms the inclined surface portion 821 and the front end wall 822, and the downstream blade portion 28*b* forms the back end wall 823 and the contact seats 21*b* of the thermistor 22 and the like.

Aluminum can be used as a high thermal-conductivity metal material, and generally well-known "extrusion process" and "drawing process" can be used as specific methods of integrally forming the reflection plate portion 81 and the heated plate portion 82 by the same metal material with a high thermal conductivity. The reflection plate portion 81 and the heated plate portion 82 can be formed through the following process.

1. Metal Mold Manufacturing Process

A metal mold necessary for the process is created as follows.

1-1. Design Metal Mold:

(1) Design a metal mold called "die" to execute an aluminum extrusion process.

(2) Use a hollow die as a type of die to create a male or female die according to the usage.

Male die: form a tunnel hollow portion at the center.

Female die: form a hollow outer surface portion and front and back wing portions.

1-2. Manufacture Metal Mold:

(3) Open a guide hole on a base material of the die based on design data (rough processing).

(4) Heat treatment (quenching, annealing).

(5) Polish the surface.

(6) Process a back hole according to the extruded shape.

(7) Process a front hole.

(8) Polish the front hole.

2. Extrusion Manufacturing Process (1) Input an aluminum ingot (ground metal) created by using a bauxite ore as a raw material to a blast furnace along with input of silicon for increasing the temperature and fuse the aluminum ingot for three hours at 1200° C.

(2) Pour the aluminum ingot to another furnace, add magnesium for increasing the strength and remove dust.

(3) Tilt the furnace to take out the aluminum and pour the aluminum into a round mold.

(4) Spray water while pulling down the bottom of the mold to harden the aluminum and create an aluminum cylinder called billet.

(5) Cut the billet in a size suitable for processing and put the billets into a heating furnace to soften the billets at a temperature of 450° C.

(6) Prepare a dice for forming the aluminum into a desirable shape (cross section) and attach the aluminum to an extruder after heating.

(7) Put the billets in the extruder.

(8) Push the billets by a hydraulic cylinder (extrude the billets while using a recipient machine at the exit to draw out the billets).

(9) Because the mold material just after the extrusion is still soft, cut the mold material in a desirable length and heat the mold material for about two hours at 200° C.

(10) Soap the hardened aluminum material in a sulfuric acid aqueous solution and apply electricity to resist rust by surface treatment, which can form a film by electrochemical reaction to resist rust and scratch.

According to the process, an aluminum reflection plate/heating slide plate with a cross section structure as in the present embodiment can be obtained by the extrusion processing method.

When the surface shape accuracy and the smoothness of the aluminum, reflection plate/heating slide plate need to be increased, the plate can be used as a base material to manufacture a new highly accurate drawing process die to make a correction in the drawing process.

The manufacturing method is used to specifically use aluminum as a metal material with a high thermal conductivity and use a base material in which the internal shape is processed in advance. A die with a cross section shape as illustrated in FIG. 7B is used to create a hollow deformed aluminum tube provided with the upstream blade portion 28*a* and the downstream blade portion 28*b* on the left and right. In this case, the thickness of the heated plate portion 82 and the reflection plate portion 81 is set to 0.5 mm, and the thickness of the front end wall 822 and the back end wall 823 as areas that receive the left and right pressure is set to 1.0 mm to ensure the rigidity. An intermediate seat blade portion 21*b*' is further formed with a thickness of 0.5 mm on the left end portion of the back end wall 823 in order to form the contact seats 21*b* for attaching the temperature sensors. Therefore, the thicknesses of the reflection plate portion 81 that functions as a reflection plate and the thickness of the heated plate portion 82 that functions as a heated plate are different.

Note that each value of the plate thickness is a reference, and for example, an adjustment can be made by restricting the minimum plate thickness to 0.8 mm in processing.

The seat blade portion 21*b*' of the temperature sensors is formed by the drawing process in the present embodiment, and the seat blade portion 21*b*' is integrated in the same shape in the longitudinal direction as illustrated in the top perspective view of FIG. 7C. Therefore, to independently detect the temperature of each portion, a cut and addition process of leaving off only the parts necessary for attaching the temperature sensors is applied as indicated by a down arrow in FIG. 7C.

The painting method of the black paint layer 21*a* important for increasing the heating efficiency of the fixing nip portion is the same as in the third embodiment.

The reflection plate portion 81 is completely integrated with the heated plate portion 82 in the present fourth embodiment, and there is no route of heat leak from the reflection plate portion 81 to members other than the heated plate portion 82, except for a little heat leak to the insulation member of the pressurization seat. Moreover, the thermal contact resistance is also eliminated by the integration without the contact interface as in the case of placing the sheet metals on top of each other. Therefore, the heat can be transferred with a higher thermal conductivity, and a configuration with a higher thermal efficiency can be realized.

Although post-processing is necessary to form the contact seats of the temperature sensors, the basic shape can be efficiently produced by the drawing process, and the production efficiency as a whole can be further improved.

In the embodiments, a thin heat-resistant resin film is simply used as an insulation material in a most inexpensive and simple method between the heated plate and the pressurization stay in order to avoid direct contact of metals with a high thermal conductivity. However, a film guide made of a heat-resistant resin may be deformed and used on arrangement of the heat-resistant resin film as additionally written in the first embodiment, or the heat-resistant resin film may be re-provided by a material with a higher thermal insulation or a thick member.

Although the image heating apparatus is applied to the fixing apparatus that heats, pressurizes and fixes the unfixed toner image formed on the recording material is the embodiments, the image heating apparatus is not limited to the fixing apparatus. For example, the image heating apparatus can also be applied as an apparatus that provides gloss to the toner image fixed on the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-055985, filed Mar. 18, 2016, which is hereby incorporated by reference herein in its entirety.

What is claimed is:

1. A fixing apparatus for fixing an image on a recording material, the fixing apparatus comprising:

a cylindrical film;

a nip member in contact with an inner surface of the cylindrical film, wherein the nip member extends in a longitudinal direction of the cylindrical film;

a heater configured to heat the nip member by radiation heat, the heater provided in a hollow portion of the cylindrical film;

a roller configured to form a nip portion with the nip member through the cylindrical film, the nip portion being a portion where the recording material on which the image has been formed is conveyed and heated to fix the image on the recording material;

a support member configured to support the nip member, wherein a cross section of the support member perpendicular to the longitudinal direction of the cylindrical film has a U-shape, and two end portions forming an opening portion in the U-shape support the nip member;

an insulation member provided between the two end portions of the support member and the nip member to bring the insulation member into contact with both the support member and the nip member and configured to suppress a leak of thermal energy from the nip member to the support member; and a reflection member provided so as to surround the heater in an area between the nip member and the support member, wherein the reflection member reflects the radiation heat of the heater toward the nip member.

2. The fixing apparatus according to claim 1, wherein a transverse end portion of the nip member is configured to engage with a transverse end portion of the reflection member.

3. The fixing apparatus according to claim 2, wherein the transverse end portion of the reflection member is connected to the nip member.

4. The fixing apparatus according to claim 1, wherein the support member is a metal pressurizing stay for pressurizing the nip member toward the roller.

5. A fixing apparatus that fixes an image on a recording material, the fixing apparatus comprising:

a cylindrical film;

a nip member in contact with an inner surface of the cylindrical film, wherein the nip member extends in a longitudinal direction of the cylindrical film, and the nip member comprises a hollow portion extending in the longitudinal direction of the cylindrical film as viewed in the longitudinal direction of the cylindrical film;

a heater configured to heat the nip member by radiation heat, the heater provided in the hollow portion;

a roller configured to form a nip portion with the nip member through the cylindrical film, the nip portion being a portion where the recording material on which the image has been formed is conveyed and heated to fix the image on the recording material;

a support member configured to support the nip member, wherein a cross section of the support member perpendicular to the longitudinal direction of the cylindrical film has a U-shape, and two end portions forming an opening portion in the U-shape support the nip member; and an insulation member provided between the two end portions of the support member and the nip member to bring the insulation member into contact with both the support member and the nip member and configured to suppress a leak of thermal energy from the nip member to the support member.

6. The fixing apparatus according to claim 5, wherein when the nip member is viewed in the longitudinal direction, a thickness of a first area in contact with the nip portion of the nip member is thicker than a second area on an opposite side of the first area across the heater.

7. The fixing apparatus according to claim 5, wherein the support member is a metal pressurizing stay for pressurizing the nip member toward the roller.

8. A fixing apparatus for fixing an image on a recording material, the fixing apparatus comprising:

a cylindrical film;

a nip member in contact with an inner surface of the cylindrical film, wherein the nip member extends in a longitudinal direction of the cylindrical film;

a heater configured to heat the nip member by radiation heat, the heater provided in a hollow portion of the cylindrical film;

a roller configured to form a nip portion with the nip portion through the cylindrical film, the nip portion being a portion where the recording material on which the image has been formed is conveyed and heated to fix the image on the recording material;

a support member configured to support the nip member, wherein a cross section of the support member perpendicular to the longitudinal direction of the cylindrical film has a U-shape, and two end portions forming an opening portion in the U-shape support the nip member;

a reflection member provided so as to surround the heater in an area between the nip member and the support member, wherein the reflection member contacts the nip member and does not contact the support member, and a thermal insulation member provided between the two end portions of the support member and the nip member to bring the thermal insulation member into contact with both the support member and the nip member.

9. The fixing apparatus according to claim 8, wherein the thermal insulation member prevents the support member from contacting the nip member.

10. The fixing apparatus according to claim 8, wherein the support member is a metal pressurizing stay for pressurizing the nip member toward the roller.

* * * * *